US005857363A

United States Patent [19]

Jung et al.

[11] Patent Number: 5,857,363

[45] Date of Patent: Jan. 12, 1999

[54] COVER STRUCTURE OF A CLOTHES WASHING MACHINE

[75] Inventors: Gue Bume Jung; Hyun Soo Oh, both of Suwon, Rep. of Korea

[73] Assignee: Samsung Electronics Co., Ltd., Suwon, Rep. of Korea

[21] Appl. No.: 692,223

[22] Filed: Aug. 7, 1996

[30] Foreign Application Priority Data

Nov. 9, 1995 [KR] Rep. of Korea ..... 1995 32804

[51] Int. Cl.[6] ..... D06F 39/14

[52] U.S. Cl. ..... 68/196; 160/206

[58] Field of Search ..... 68/196, 232, 235, 68/237; 160/199, 206

[56] References Cited

U.S. PATENT DOCUMENTS

| | | | |
|---|---|---|---|
| 2,411,419 | 11/1946 | Frohnapel | 160/206 |
| 2,585,645 | 2/1952 | Freitag | 160/206 |
| 2,753,828 | 7/1956 | Mege | 160/206 |
| 2,807,461 | 9/1957 | Nes | 160/206 |
| 2,946,304 | 7/1960 | Greer et al. | 160/206 |
| 3,045,462 | 7/1962 | Brown | 68/196 |
| 3,045,746 | 7/1962 | Kummerman | 160/206 |
| 3,169,502 | 2/1965 | Groppell | 160/206 |
| 3,498,092 | 3/1970 | Berry et al. | 68/196 |
| 5,546,773 | 8/1996 | Lee | 68/196 |

*Primary Examiner*—Frankie L. Stinson

*Attorney, Agent, or Firm*—Burns, Doane, Swecker & Mathis, L.L.P.

[57] ABSTRACT

The leading end of the first member (21) of a cover assembly (20) is provided with rolls (30) in order to smoothly guide the cover assembly along sloped guide surfaces (13L and 13R), so that frictional damages are prevented as well as noises.

2 Claims, 6 Drawing Sheets

COVER STRUCTURE OF A CLOTHES WASHING MACHINE

BACKGROUND OF THE INVENTION

The present invention concerns a clothes washing machine having a foldable cover assembly.

Generally, a washing machine is automatically controlled by a microcomputer programmed to wash and rinse clothes, to discharge water, and to extract water from the soaked clothes. Referring to FIG. 6, such a washing machine comprises a water reservoir (not shown) fixedly mounted in a housing 10 for storing a given amount of washing water, a washing basket 12 mounted in the water reservoir with a pulsator 11, and a drive means (not shown) for supplying a drive power required for washing operation.

The housing 10 has at the top a cover frame 13 with an opening 14 for loading and unloading clothes, a control panel 15 for controlling the washing machine, and a water supply hose 16. The cover frame 13 is provided with a hinged cover assembly 20 for closing or opening the top opening 14.

The cover assembly 20 comprises a first plate member 21 and a second plate member 22 to facilitate the opening and closing. The second member 22 is hinged to the rear side of the cover frame 13 while the first and the second member 21 and 22 are connected foldably with each other by means of a hinge 23. In addition, a depressed grip 24 is provided at the central outside part of the first member 21.

When loading or unloading clothes into or from the washing basket 12, the first member 21 is raised upwardly by means of the grip 24 so that the first and second members 21 and 22 are folded toward each other about the hinge 23 for opening the cover assembly 20. On the contrary, for closing the cover assembly 20, the first member 21 is pulled downward by means of the grip 24 so that the first and second members 21 and 22 are unfolded and extended about the hinge 23.

Such a conventional washing machine suffers a drawback that the leading end 21A of the first member 21 is forcibly dragged making a great friction with the surfaces of the cover frame 13 so that the frictional parts are greatly damaged together with generating great frictional noises.

SUMMARY OF THE INVENTION

It is an object of the present invention to provide a washing machine with a means for facilitating the movement of the cover assembly upon loading or unloading clothes into or from the washing basket.

It is another object of the present invention to provide a washing machine with a means for preventing wear due to frictional contact between the cover assembly and the cover frame.

According to the present invention, a clothes washing machine comprises a housing with a top opening for loading and unloading clothes, a washing basket rotating on a vertical shaft and mounted in the housing, a cover frame formed on the top opening, the cover frame having a pair of inclined guide surfaces, and a cover assembly with foldable first and second member attached to the cover frame for closing or opening the top opening, wherein one end of the first member is attached to one end of the second member by means of a hinge, with the other end of the second member hinged at one side of the cover frame, and the other end of the first member having a pair of roll means for respectively rolling on the pair of guide surfaces so as to move the cover assembly to the opening or closing position.

Preferably, each of the roll means comprises a roll with a shaft arranged in parallel with the hinge axes, and a bracket inserted in the cover assembly for rotatably mounting the roll.

The present invention will now be described with reference to the drawings attached only by way of example.

BRIEF DESCRIPTION OF THE ATTACHED DRAWINGS

DETAILED DESCRIPTION OF PREFERRED EMBODIMENTS

Figure 1:
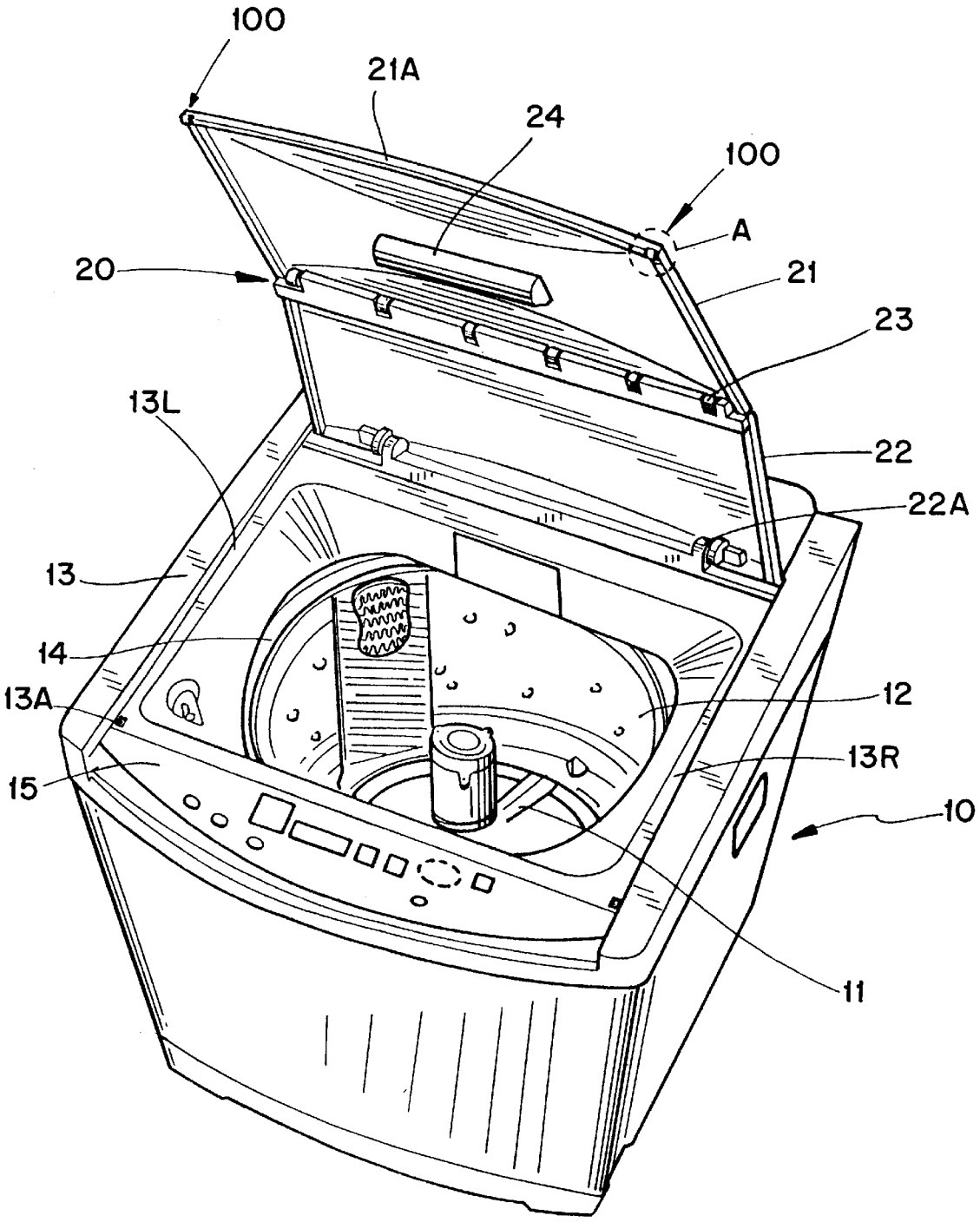
FIG. 1 is a perspective view for illustrating the inner surface of the cover assembly of a washing machine according to the present invention.
Figure 2:
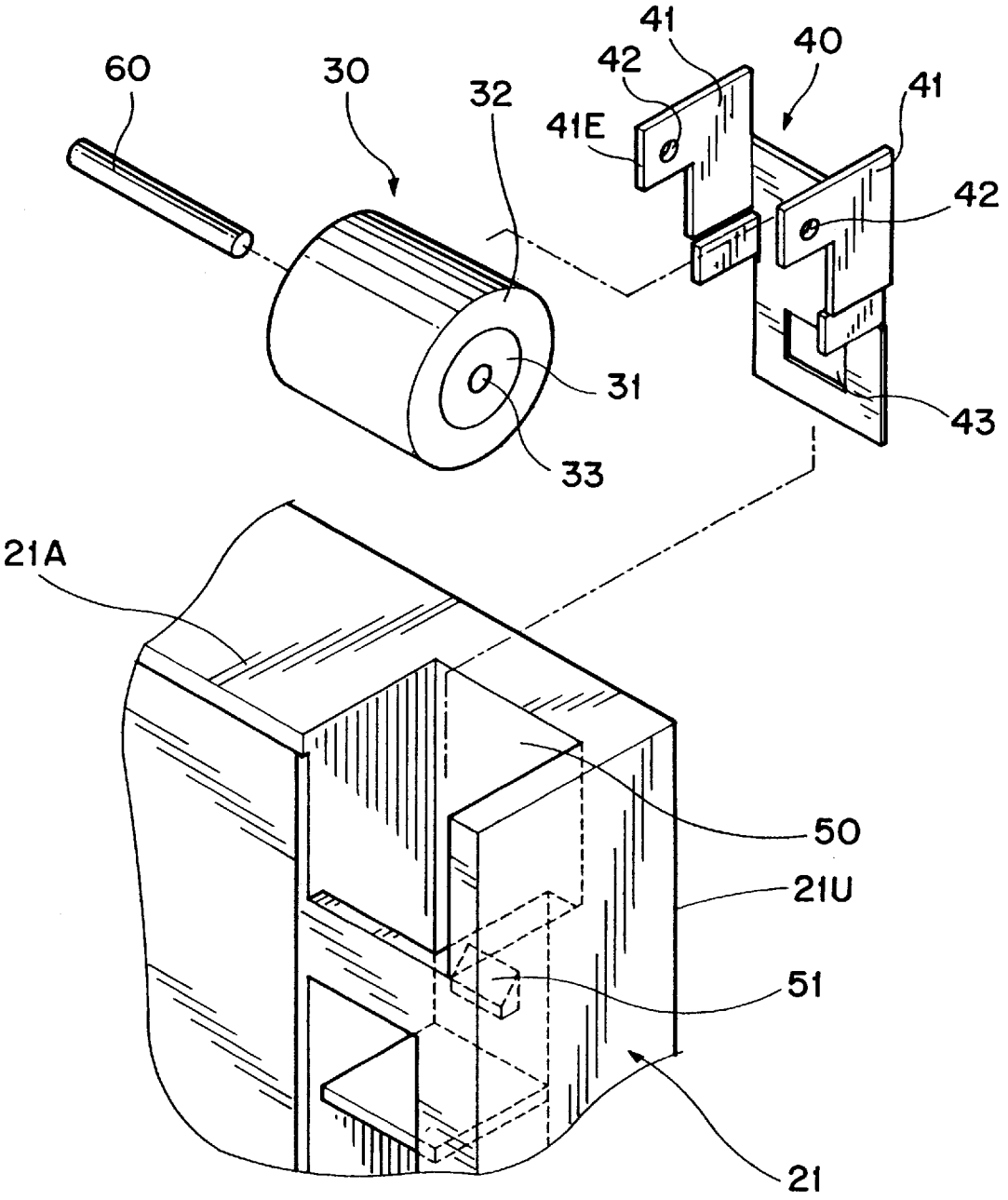
FIG. 2 is an exploded perspective view of the part indicated by symbol 'A' in FIG. 1.

Referring to FIGS. 1 and 2, there is shown a first member 21, of which the leading end 21A cooperates with the upper surfaces of a cover frame 13 and has a pair of roll devices 100. Each of the roll devices 100 includes a roll 30 and a bracket 40 for mounting the roll. The bracket 40 is inserted into a pocket 50 formed in the leading end 21A.

The roll 30 comprises a hub 31 made of a plastic material and a roll part 32 made of a rubber with length sufficient to cover the periphery of the yoke 31. The rubber absorbs the vibrations generated by the operation of the washing machine. The hub has a central shaft hole 33 for freely receiving a shaft 60.

The bracket 40 has a pair of support plates 41 for supporting both ends of the roll 30 by means of the shaft 60 fixedly mounted through a pair of holes 42. The holes 42 formed in the support plates are formed adjacent to the outer edges 41E of the support plates 41 so that the roll 30 is somewhat protruded outwardly beyond those edges 41E. The rear side of the bracket 40 has a locking aperture 43 for receiving a locking protuberance 51 formed in the pocket 50.

The roll 30 is rotatably mounted on the bracket 40 by means of the shaft 60 fixed in the holes 42 while the bracket 40 is mounted in the pocket 50 formed in the leading end 21A of the first member 21. The locking protuberance 51 is formed on the rear wall of the pocket 50 so as to be locked in the locking aperture 43 of the bracket 40. The roll 30 is protruded outwardly i.e., downwardly in FIGS. 3–5 from the leading end 21A of the first member 21 so as to properly contact a pair of guide surfaces 13L and 13R formed on the cover frame 13 when the first member 21 rotates around the hinge 23.

Figure 3:
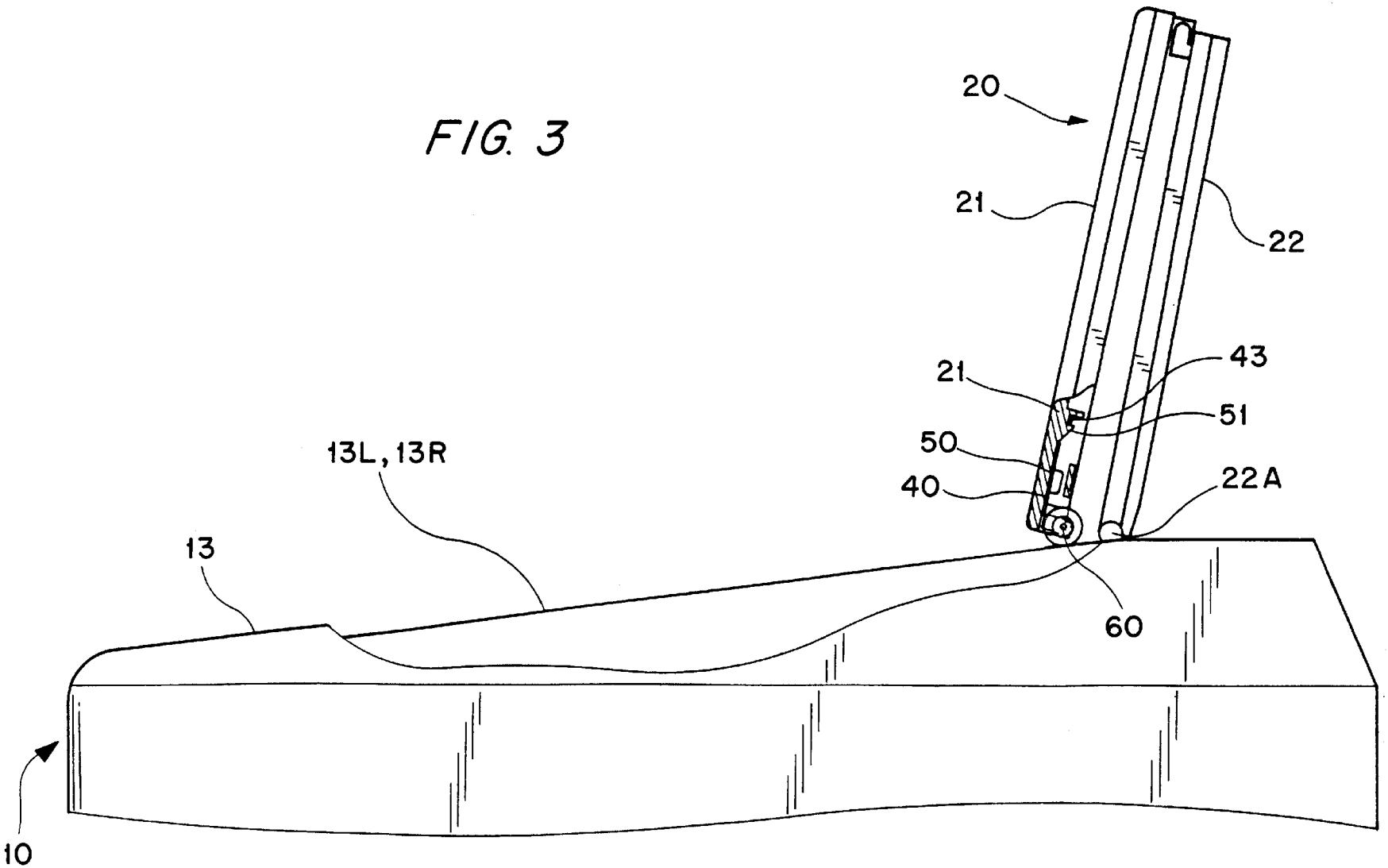
FIG. 3 is a schematic side elevational view for illustrating the open state of the cover assembly according to the present invention.

The guide surfaces 13L and 13R are ultilized for guiding the rolls so as to smoothly open or close the cover assembly 20. They are sloped downwardly toward the front portion of the washer from the position at which the roll devices 100 are disposed when the cover assembly 20 is completely opened as shown in FIG. 3. The rear ends of the guide surfaces 13L and 13R maintain a slope enabling the roll devices 100 to contact the guide surfaces.

Figure 4:
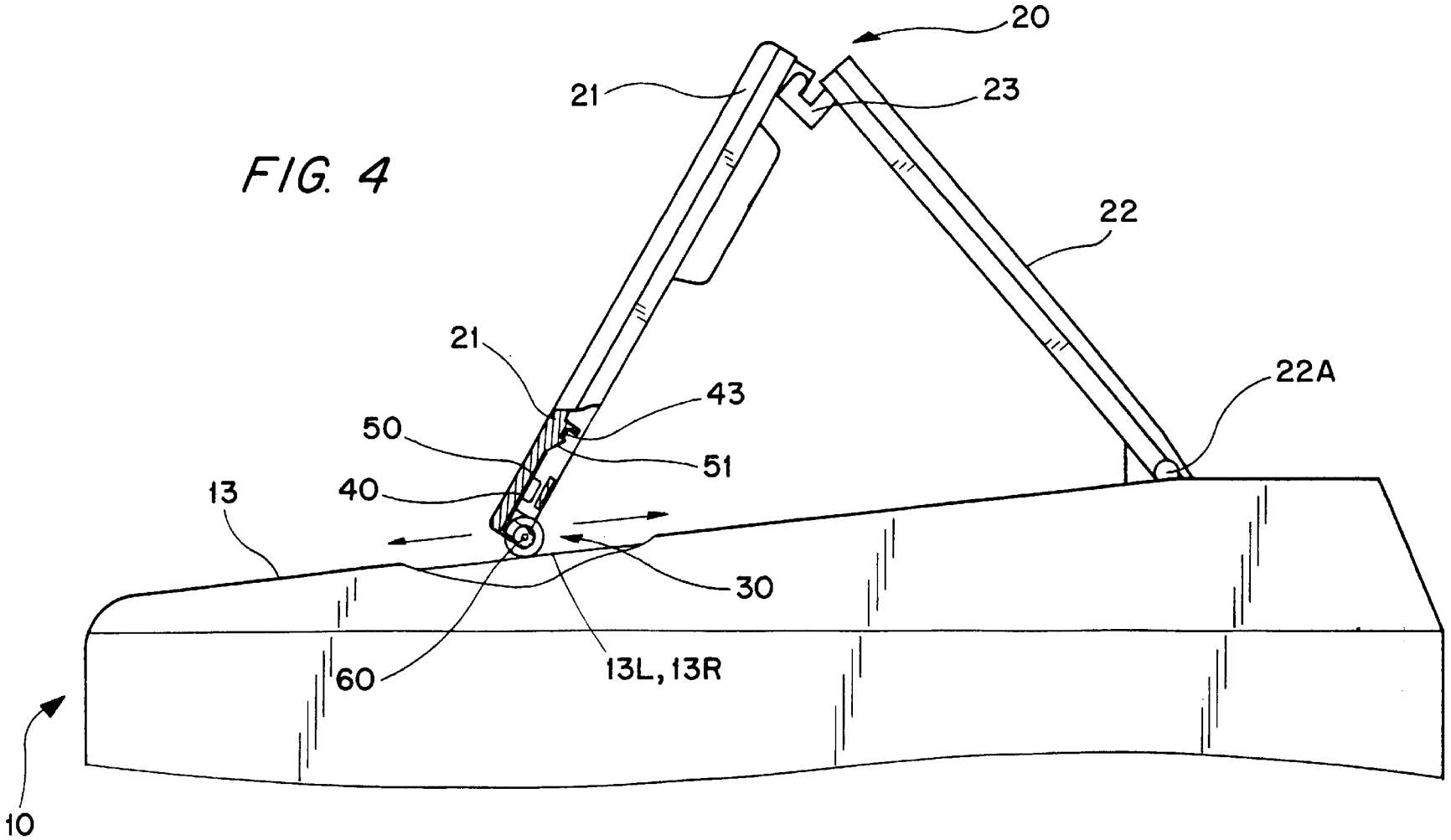
FIG. 4 is a view similar to FIG. 3 for illustrating an intermediate stage of the movement of the cover assembly according to the present invention.
Figure 5:
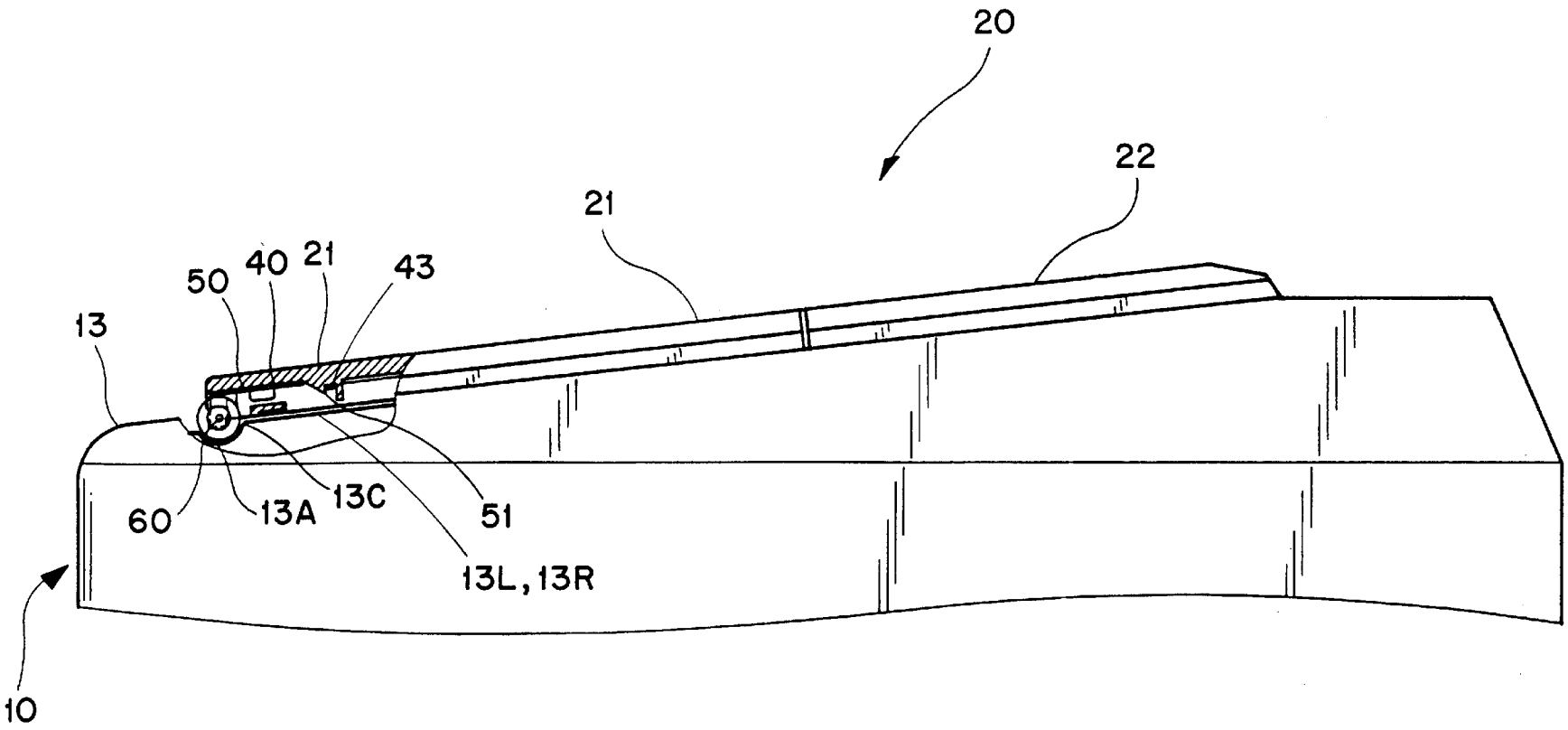
FIG. 5 is a view similar to FIG. 3 for illustrating the closed state of the cover assembly according to the present invention.
Figure 6:
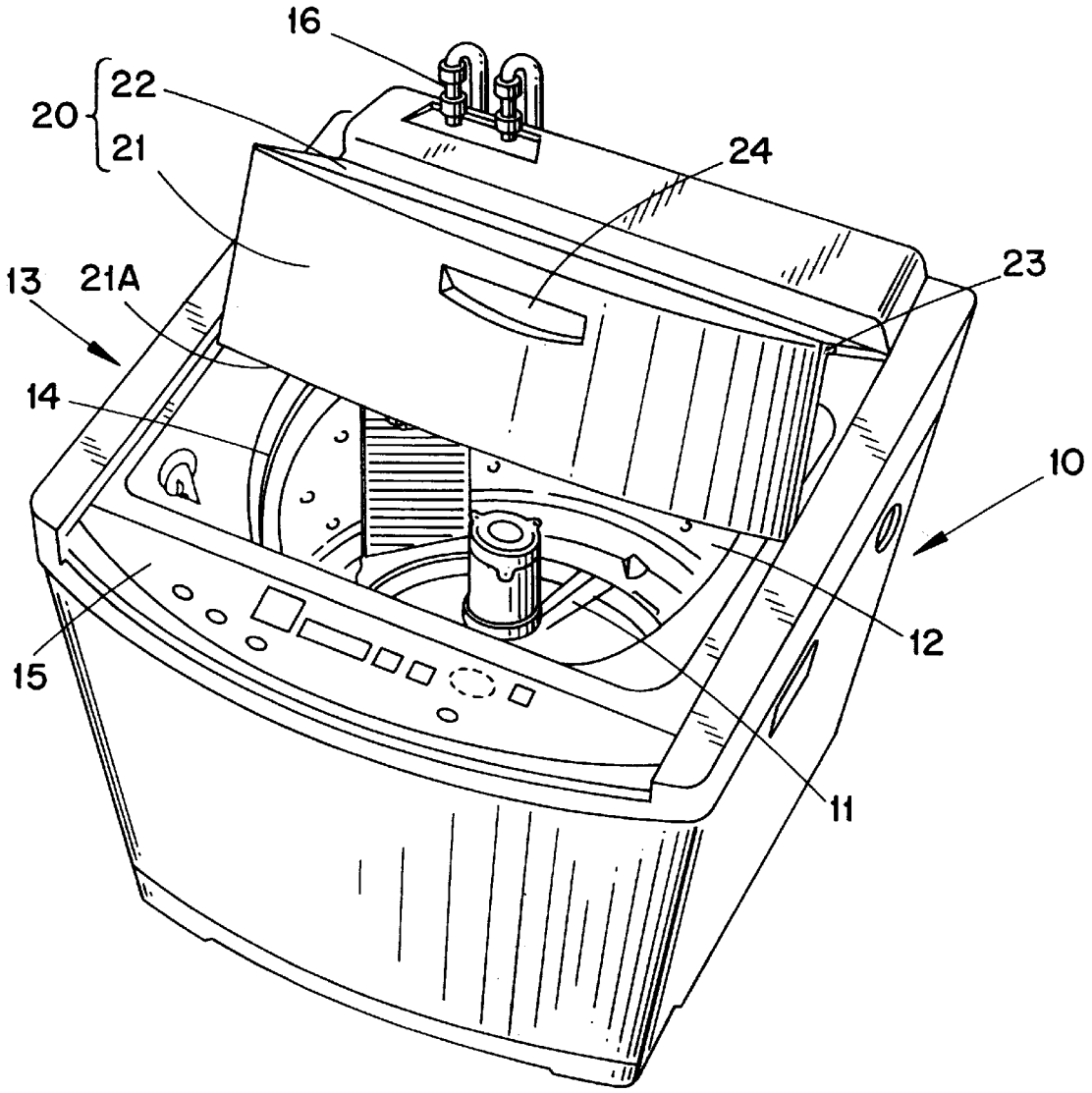
FIG. 6 (PRIOR ART)
FIG. 6 is a perspective view for illustrating a conventional washing machine.

In operation, when loading or unloading clothes into or from the washing basket 12, the first member 21 is raised upwardly by grasping the grip 24 in the closed position of the cover assembly 20 as shown in FIG. 5, so that the first and second members 21 and 22 are folded by means of the hinge 23 as shown in FIG. 4, and additionally the second member 22 is pivoted upwardly by means of the hinge 22A, thus completely opening the cover assembly 20 as shown in FIG. 3.

In this case, the leading end 21A of the first member 21 is smoothly guided by the cooperation of the rolls 30 and the guide surfaces 13L and 13R of the cover frame 13, so that no frictional noise or damage occurs as could be caused by direct contact between the leading end 21A and the cover frame 13.

For closing the cover assembly 20, the first member 21 is pulled downwardly by pulling on the grip 24 so that the first and second members 21 and 22 are unfolded away from each other, and additionally the second member 22 is pivoted downwardly on the hinge 22A, thus closing the cover assembly 20 as shown in FIG. 5. Likewise, the first member 21 is smoothly guided by the cooperation of the rolls 30 of the leading end 21A and the guide surfaces of the cover frame 13.

When the cover assembly 20 is completely closed , the rolls 30 are respectively inserted into cup-shaped depressions 13A formed at the front ends of the guide surfaces 13L and 13R, as shown in FIG. 5 so that the cover assembly 20 may be in close contact with the cover frame 13. Additionally, the edge between the cup-shaped depression and the guide surface is rounded so as to facilitate the movement of the roll 30 from or into the depression 13A.

Thus, the present invention provides various advantages such as preventing frictional damage to the cover assembly, reducing noises, facilitating the movement of the cover assembly, preventing distortion of the cover assembly, etc. Moreover, the rolls and brackets may be easily replaced when damaged.

What is claimed is:

1. A clothes washing machine comprising:

a housing with a top wall forming an access opening for loading and unloading clothes, and a pair of guide surfaces disposed on opposite sides of said access opening;

a washing basket rotating on a vertical shaft and mounted in said housing;

a cover assembly attached to said top wall for closing and opening said access opening, said cover assembly comprising first and second members, wherein one end of said first member is hinged to one end of said second member by means of a first hinge, with the other end of said second member hinged to said top wall by a second hinge, and the other end of said first member having a pair of roll devices for rolling on respective ones of said guide surfaces during movement of said cover assembly to an open position and a closed position, said guide surfaces being sloped downwardly in a direction traveled by said roll devices during a closing of said cover assembly;

wherein each of said roll devices comprises a roller having a shaft arranged in parallel with respective axes of said first and second hinges, and a bracket inserted in said cover assembly for rotatably mounting said roller, a front end of each guide surface having an upwardly open cup-shaped depression for receiving a respective roller when the cover assembly is closed, to cause the cover assembly to approach the top wall.

2. A clothes washing machine as defined in claim 1, wherein each of said cup-shaped depressions is separated from an adjacent portion of a respective one of said guide surfaces by a rounded edge.

* * * * *